US005698810A

United States Patent [19]

Rose

[11] Patent Number: 5,698,810

[45] Date of Patent: Dec. 16, 1997

[54] CONVERTIBLE BALLISTIC OPTIMIZING SYSTEM

[75] Inventor: Clyde E. Rose, South Weber, Utah

[73] Assignee: Browning Arms Company, Morgan, Utah

[21] Appl. No.: 564,461

[22] Filed: Nov. 29, 1995

[51] Int. Cl.[6] ..... F41C 27/22

[52] U.S. Cl. ..... 89/14.3; 42/97

[58] Field of Search ..... 42/79, 97, 96; 89/14.2, 14.3, 14.4, 30, 31

[56] References Cited

U.S. PATENT DOCUMENTS

| | | | |
|---|---|---|---|
| Re. 20,958 | 12/1938 | White | 42/79 |
| 1,892,522 | 12/1932 | White . | |
| 2,153,246 | 4/1939 | Gibson | 42/79 |
| 2,165,457 | 7/1939 | Cutts . | |
| 2,191,484 | 2/1940 | Hughes . | |
| 2,302,699 | 11/1942 | Klipsch . | |
| 2,340,821 | 2/1944 | Russell . | |
| 2,372,568 | 3/1945 | Grigg . | |
| 2,423,109 | 7/1947 | Monnet | 89/14.1 |
| 2,428,232 | 9/1947 | Limon | 42/79 |
| 2,442,899 | 6/1948 | McAllister | 42/79 |
| 2,453,747 | 11/1948 | Egleson | 42/79 |
| 2,466,104 | 4/1949 | Hilburn | 42/79 |
| 2,484,998 | 10/1949 | Hutchinson | 42/79 |
| 2,499,428 | 3/1950 | Tiffany . | |
| 2,558,200 | 6/1951 | Schmeling | 42/79 |
| 2,589,738 | 3/1952 | Sedberry | 42/79 |
| 2,629,958 | 3/1953 | Roper et al. | 42/79 |
| 2,656,637 | 10/1953 | Richards | 42/79 |
| 2,662,326 | 12/1953 | Powell | 42/79 |
| 2,668,479 | 2/1954 | Batten . | |
| 2,712,193 | 7/1955 | Mathis | 89/14.3 |
| 2,770,904 | 11/1956 | Weiss . | |
| 2,796,005 | 6/1957 | Shapel | 89/14.3 |
| 2,809,560 | 10/1957 | Matson . | |
| 2,859,444 | 11/1958 | Reymond . | |

(List continued on next page.)

FOREIGN PATENT DOCUMENTS

| | | | |
|---|---|---|---|
| 588100 | 12/1959 | Canada | 89/14.3 |
| 127231 | 11/1919 | United Kingdom | 42/105 |
| 594515 | 11/1947 | United Kingdom . | |

OTHER PUBLICATIONS

Article, Boss—Ballistic Optimizing Shooting System Undated.

Advertisement and Order form for Que Industries'—Adjustable Muzzle Brake Undated.

American Firearms Technologies, Ltd Catalogue Undated.

D.S. Tanabe of Seattle, Washington, Contra-Jet Muzzle Brake Brochure, 1971.

Precision Shooting Magazine, advertisement entitled "Accu-Brake SA," Nov. 1995.

Advertising materials from Hoehn Sales, Inc. "Introducing The '4000 Plus'" May 5, 1995.

Article in Dec. 1995 edition of Precision Shooting, "A Comparison of Several Barrel Tuning Devices," by Bruce A. Buckner, Jr.

Advertisement in Jun. 1995 edition of Precision Shooting, Time Precision, Inc., *Supertune.*

Advertisement in Aug. 1995 edition of *American Hunter,* "Gear, Gagets & Goodies, Adjustable Muzzle Brakes."

*Primary Examiner*—Michael J. Carone
*Assistant Examiner*—Christopher K. Montgomery
*Attorney, Agent, or Firm*—Foster & Foster

[57] ABSTRACT

A convertible ballistic optimizing system includes a main body portion adjustably secured to the muzzle end of a firearm. A retainer, such as a lock nut, is utilized to secure the main body portion in a particular axially position to change vibrational characteristics of the firearm barrel so that the bullet exits the muzzle end of the firearm when the barrel is undergoing the least amount of transverse movement. The main body portion includes a plurality of apertures that function as a muzzle brake when a weight element is attached to the outlet end of the main body portion. Alternatively, in place of the weight, a sleeved end piece can be secured to the outlet end of the main body portion to cover the apertures, thereby disabling the muzzle brake feature, without adversely affecting the inherent accuracy of the firearm.

25 Claims, 7 Drawing Sheets

U.S. PATENT DOCUMENTS

| | | | |
|---|---|---|---|
| 2,869,272 | 1/1959 | Coyle | 42/79 |
| 2,883,781 | 4/1959 | Harvey . | |
| 2,921,396 | 1/1960 | Larson . | |
| 2,953,972 | 9/1960 | Sorenson . | |
| 3,114,289 | 12/1963 | Aulabaugh . | |
| 3,164,060 | 1/1965 | Dahl . | |
| 3,187,633 | 6/1965 | Tanabe . | |
| 3,202,056 | 8/1965 | Seeberger . | |
| 3,208,348 | 9/1965 | Lee . | |
| 3,243,910 | 4/1966 | Weiser | 42/79 |
| 3,340,641 | 9/1967 | Recker . | |
| 3,455,203 | 7/1969 | Pillersdorf . | |
| 3,492,750 | 2/1970 | Ashbrook | 42/79 |
| 3,604,136 | 9/1971 | Edwards . | |
| 3,618,245 | 11/1971 | Pruonto . | |
| 3,698,747 | 10/1972 | Wing et al. . | |
| 3,714,864 | 2/1973 | Thierry . | |
| 3,732,778 | 5/1973 | Bettermann et al. . | |
| 3,971,285 | 7/1976 | Ellis et al. | 89/14.3 |
| 4,341,283 | 7/1982 | Mazzanti | 181/223 |
| 4,374,484 | 2/1983 | Bekker et al. . | |
| 4,392,413 | 7/1983 | Gwinn, Jr. . | |
| 4,510,843 | 4/1985 | Rabatin | 89/14.4 |
| 4,558,532 | 12/1985 | Wright | 42/94 |
| 4,635,528 | 1/1987 | McQueen | 89/14.3 |
| 4,726,280 | 2/1988 | Frye | 89/14.05 |
| 4,813,333 | 3/1989 | Garris et al. | 89/14.3 |
| 4,869,151 | 9/1989 | Chahin | 89/14.3 |
| 4,879,942 | 11/1989 | Cave | 89/143 |
| 4,913,031 | 4/1990 | Werner et al. | 89/14.3 |
| 4,971,208 | 11/1990 | Reinfried, Jr. | 211/64 |
| 5,058,302 | 10/1991 | Minneman | 42/94 |
| 5,092,223 | 3/1992 | Hudson | 89/14.2 |
| 5,105,717 | 4/1992 | Pond | 89/14.3 |
| 5,119,716 | 6/1992 | Bartolles | 89/14.3 |
| 5,173,563 | 12/1992 | Gray | 42/94 |
| 5,279,200 | 1/1994 | Rose | 89/14.3 |
| 5,333,529 | 8/1994 | Brockman | 89/14.3 |
| 5,425,298 | 6/1995 | Coburn | 89/14.3 |

CONVERTIBLE BALLISTIC OPTIMIZING SYSTEM

TECHNICAL FIELD

This invention relates to accuracy enhancement systems for firearms, and more particularly to ballistic optimizing systems for adjusting vibrational characteristics of a firearm barrel to improve bullet accuracy.

BACKGROUND OF THE INVENTION

The advantages of ballistic optimizing systems, such as my previous invention described in U.S. Pat. No. 5,279,200, are fast becoming well-known in the shooting industry. My prior ballistic optimizing system involves attaching an adjustable weight element to the muzzle end of a firearm barrel, and moving the weight axially along the barrel to change vibrational characteristics of the barrel so that the bullet exits the barrel while the barrel is experiencing the least amount of transverse movement. The weight attached to the end of the barrel can be axially adjusted so that transverse barrel movement due to vibrations can be matched with a variety of different bullet weights, powder charges, and other variables with respect to firearm cartridges to achieve high levels of accuracy. This revolutionary technology has set a new standard for bullet accuracy in the shooting industry.

The ballistic optimizing system disclosed in U.S. Pat. No. 5,279,200 includes a muzzle brake (i.e., a plurality of apertures formed in the body of the system to vent propulsion gases resulting from a bullet travelling through a firearm barrel) to achieve approximately a 35% to 45% reduction in recoil, depending on the caliber of the firearm. Depending upon the particular shooter, reduction in recoil can improve accuracy by minimizing the natural tendency to flinch or jerk when squeezing the trigger in anticipation of the recoil. Hence, for many shooters, reduction in recoil, particularly with respect to large caliber firearms, will increase accuracy. Many shooters are, however, relatively immune to the adverse effects of recoil. For such shooters, the ballistic optimizing system has proven to be extremely accurate even without use of a muzzle brake.

Therefore, shooters relatively immune to the adverse effects of recoil may selectively wish to disable the muzzle brake feature of the ballistic optimizing system. Still at other times a shooter who may not necessarily be affected adversely by recoil may wish to utilize the benefits of a muzzle brake when firing multiple rounds at a time.

An adverse side effect of using traditional muzzle brakes is that it has generally resulted in an increase in muzzle blast noise generated from discharging propulsion gases laterally through the venting apertures of the muzzle brake. Although various efforts have been made to minimize the increase in muzzle blast noise from the use of traditional muzzle brakes, there remains a need to provide a convertible ballistic optimizing system that would allow the shooter to selectively enable or disable a muzzle brake and while maintaining the benefits of increased bullet accuracy from using the ballistic optimizing system.

SUMMARY AND OBJECTS OF THE INVENTION

It is a primary object of the present invention to provide a ballistic optimizing system that can be converted from a system incorporating a muzzle brake to a system without muzzle brake.

Another object of the invention is to provide a convertible ballistic optimizing system by which the accuracy of the firearm, enhanced by the ballistic optimizing system, is not adversely affected by the enabling or disabling of a muzzle brake.

Still another object of the invention is to provide a ballistic optimizing system wherein an adjustable weight can be optionally replaced with a sleeved end piece to disable the muzzle brake without changing appreciably the accuracy of the firearm after adjustments to the ballistic optimizing shooting system have been made.

The foregoing objects are achieved by a ballistic optimizing system including a main body portion secured to the muzzle end of a firearm. The main body includes a plurality of apertures for venting propulsion gases resulting from a bullet being propelled through a firearm barrel, a retainer for securing the main body portion in a feed axial position on the firearm barrel, and a weight secured to the main body portion. The weight, being attached at the outlet end of the main body portion, allows propulsion gases to escape through the apertures in the main body portion. A sleeved end piece can alternatively be secured inside the outlet end of the main body portion. The sleeved end piece includes an elongated sleeve section that covers the apertures thereby disabling the muzzle brake. Installing the sleeved end piece does not adversely affect bullet accuracy resulting from the ballistic optimizing system. The sleeved end piece is configured to match the particular weight it is replacing so the vibrational characteristics of the firearm barrel do not change appreciably when the components are interchanged.

Other objects, features, and advantages of the invention will become apparent from the following detailed description of the invention with reference to the accompanying drawings.

BRIEF DESCRIPTION OF THE DRAWINGS

Preferred embodiments of the invention are described below with reference to the accompanying drawings.

DETAILED DESCRIPTION OF THE INVENTION

Figure 1:
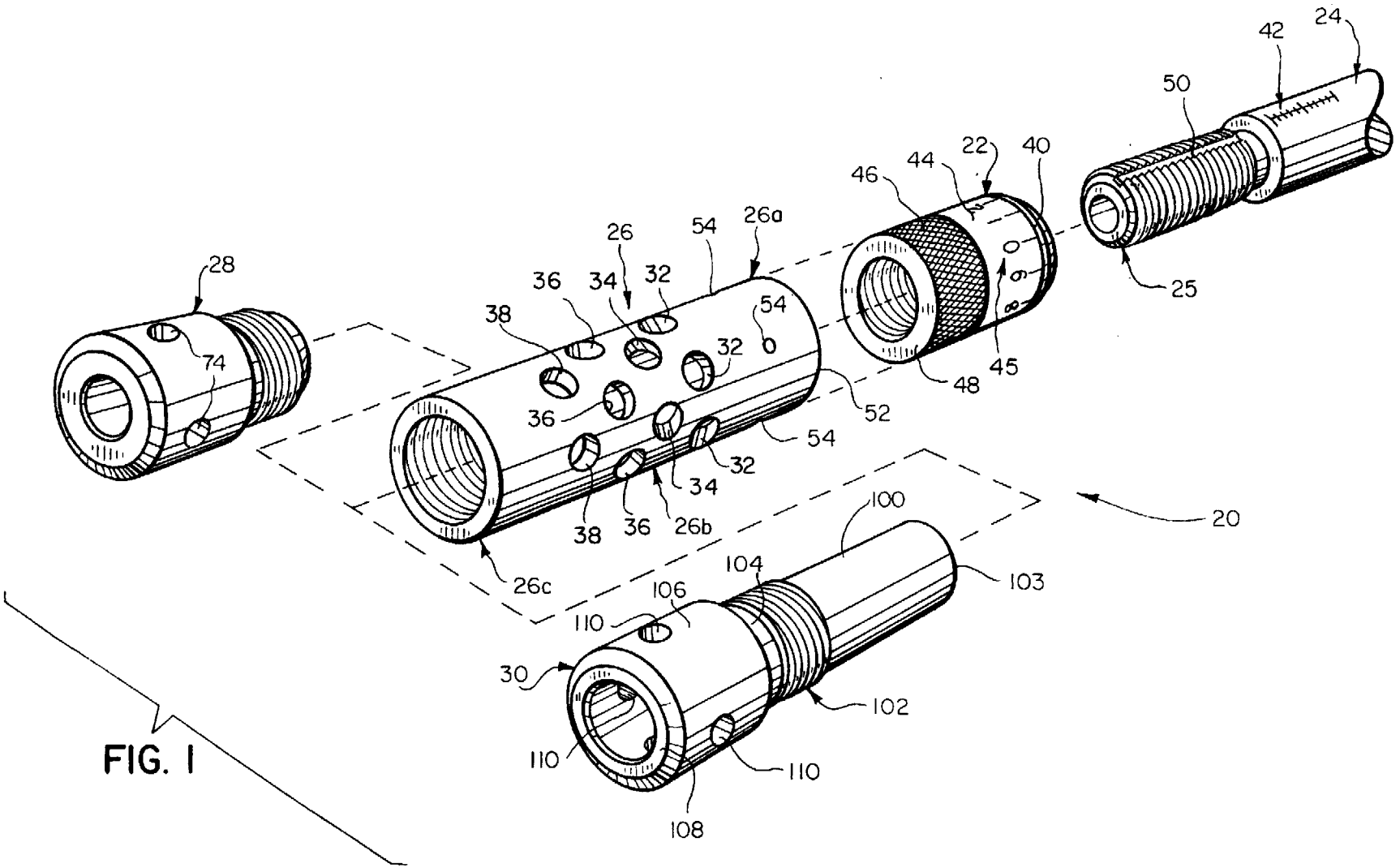
FIG. 1 is an exploded perspective view of a convertible ballistic optimizing system according to the present invention.

FIG. 1 shows a ballistic optimizing system 20 for firearms according to the present invention. The system comprises generally a lock nut 22 threadedly coupled to a threaded end 25 of a firearm barrel 24, a main body portion 26 also threadedly coupled to the threaded end 25 of the firearm barrel 24 adjacent the lock nut 22, a distal end weight 28 securable to the outlet end of the main body portion 26, and a sleeved end piece 30 also securable to the outlet end of the main body portion 26. Either the weight 28 or the sleeved end piece 30 are optionally securable to the outlet end of the main body portion 26. The weight may be attached to the main body portion to allow a plurality of apertures 32, 34, 36, 38 to vent propulsion gases generated from discharging the firearm. The sleeved end piece 30 may alternatively be secured to the main body portion 26 to cover the apertures 32, 34, 36, and 38 and disable the muzzle brake feature, thus directing all propulsion gases out of the muzzle end of the firearm barrel and through the sleeved end piece 30.

Figure 2:
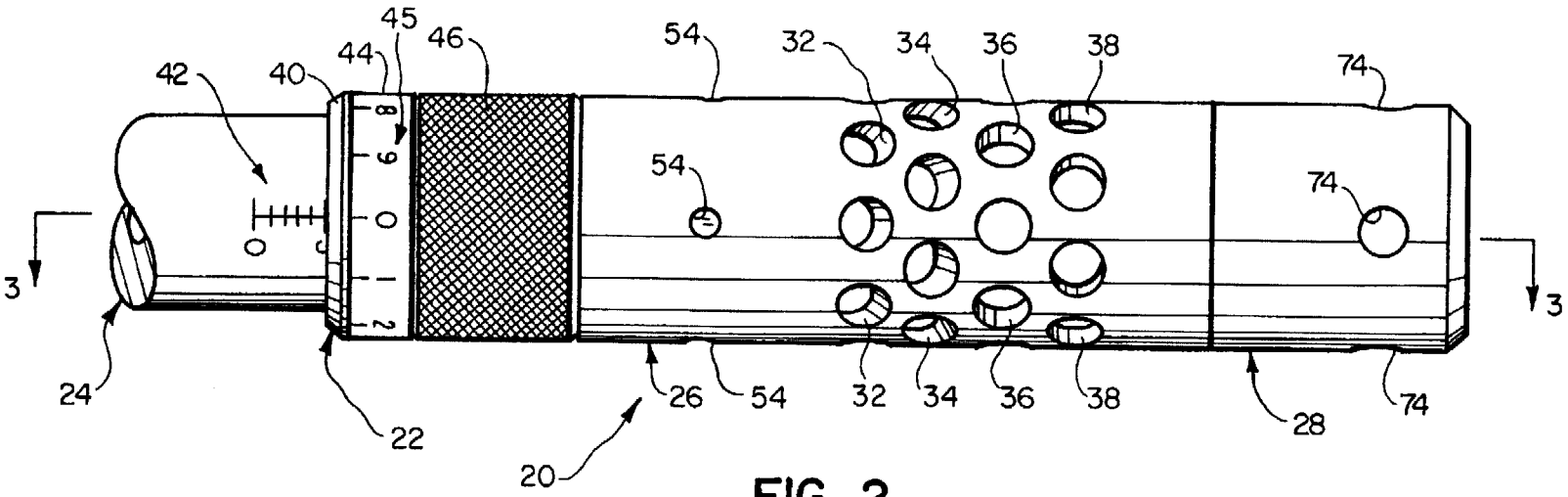
FIG. 2 is a top view of the convertible ballistic optimizing system of FIG. 1 showing a weight attached to a main body portion threadedly coupled to a firearm barrel and secured at a particular axial position by means of a lock nut.
Figure 3:
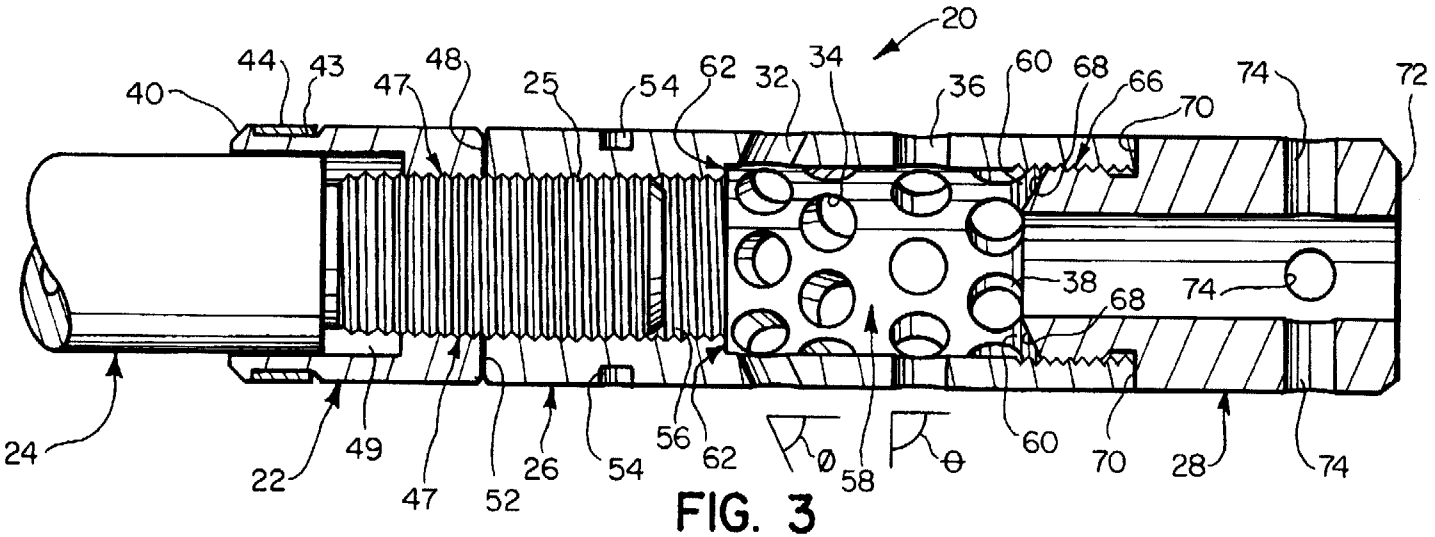
FIG. 3 is a partial sectional side elevation view, taken along the line 3—3 of FIG. 2, of the ballistic optimizing system of the present invention.

FIGS. 2 and 3 show one preferred embodiment of a convertible ballistic optimizing system 20 according to the present invention. Specifically, a firearm barrel 24 includes a threaded muzzle end portion 25 to which the ballistic optimizing system is secured. A retaining member, such as a lock nut 22, is first threaded over the end portion 25. The lock nut 22 includes a sloped reference surface 40 for referencing indicia 42, such as a graduated linear scale, disposed on the firearm barrel 24. An annular channel 43 is formed about the lock nut 22 adjacent the sloped reference surface. A number band 44 is disposed inside the channel 43. The number band is indexed to zero by rotating the lock nut 22 to its rearwardmost position, after which the number ring 44 is rotated until the "0" reference point on the indicia 45 corresponds with the center reference line of the linear scale 42 disposed on the firearm barrel 24. The number band is then secured in position using a suitable adhesive.

A knurled surface 46 is formed on an outside surface of the lock nut adjacent the number ring 44 to provide a gripping surface for rotating the lock nut 22 about the firearm barrel 24. By rotating the lock nut 22, the sloped reference surface 40 moves either up or down axially along the firearm barrel 24 and references the appropriate graduation on scale 42. By referencing the scale 42 on the firearm barrel, the lock nut 22 and barrel cooperate with one another to create a micrometer-like indexing system so precision adjustments can be made. There are preferably ten graduations formed in or provided on the outside surface of the number band indicia 45. One full revolution of the lock nut 22 about the barrel will cause the lock nut to move axially along the firearm barrel one index marking on the graduated linear scale 42.

With reference to FIG. 1, a groove 50 for a nylon strip is formed in the threaded muzzle end portion 25 of the firearm barrel. The lock nut 22 includes interior threads 47 (FIG. 3), which engage the threaded end portion 25 and the nylon strip. The nylon strip creates friction with the threads of the lock nut to prevent undesired movement of the lock nut 22 and main body 26 relative to the firearm barrel 24. It is to be understood that although a preferred embodiment of the present invention involves the use of a threaded connection between the muzzle end of the firearm barrel 24 and the lock nut 22, other types of connections may be used without departing from the scope of the present invention. This similarly applies to the connections between other components of the ballistic optimizing system of the present invention.

The lock nut 22 terminates at an abutment surface 48 (FIG. 1) which engages an opposing abutment surface 52 (FIG. 10) of the main body portion 26. An inner pocket 49 (FIG. 3) is formed within the lock nut 22. The pocket 49 is sized to allow free rotation of the lock nut relative to the non-threaded portions of the firearm barrel.

As mentioned above, the main body portion defines a plurality of ports or apertures 32, 34, 36, 38 which provide passageways or vent ports extending from a venting chamber 58 formed in the main body portion 26 to the exterior of the firearm. The plurality of apertures are formed in rows, with each row extending radially outward from a common point on the central, longitudinal axis of the main body portion. A first row of apertures 32 is formed in the main body portion, with the apertures converging toward the longitudinal axis of the main body portion. Similarly, a row of apertures 34 is formed in the main body portion with the apertures converging from their points of origin on the outside surface of the main body portion toward their common point on the longitudinal axis of the main body portion. The two additional rows of apertures 36, 38 are formed in the main body portion and extend radially perpendicularly outwardly from the longitudinal axis thereof. The gases exiting from venting chamber 58 via ports 32, 34, 36, and 38 impinge upon each other to create turbulence and reduce concussion felt by the shooter.

As shown in FIG. 3, the rows of apertures 32, 34 are formed in the main body portion at an angle $\phi$ relative to the longitudinal axis of the main body portion. In the embodiment of FIGS. 2 and 3, angle $\phi$ is approximately 60° relative to the longitudinal axis. The rows of apertures 36, 38 extend perpendicularly from the longitudinal axis at an angle $\theta$, which is preferably 90°. It is to be understood, however, that the apertures may be angled at various degrees and in various combinations without departing from the scope of the present invention. Adjacent radially extending rows are offset one with another to form an offset pattern. It is to be understood that various aperture patterns may be used without departing from the scope of the present invention.

The main body portion 26 further defines a plurality of detents 54 formed about the periphery of the main body portion 26. The detents are formed at 90° positions relative to one another on the outer surface of the main body portion. The detents provide locations for inserting a specialized tool (described below in connection with FIGS. 9 and 10) for securing the main body portion to and removing the main body portion from engagement with lock nut 22.

Referring to FIGS. 1 and 3, the main body portion 26 still further defines an inner cavity which includes a threaded section 56 at the inlet end 26*a* of the main body portion 26, a propulsion gas venting chamber 58 formed within the middle section 26*b* of the main body portion, and a threaded section 60 at the outlet end 26*c* of the main body portion. Within the venting chamber 58, an annular shoulder 62 is formed by the main body portion at an end of the venting chamber proximate the threaded inlet end area 56.

The weight 28 comprises a central passageway 64 (FIG. 5), through which the bullet travels after it passes through the propulsion gas venting chamber 58. The main passageway 64 is oversized relative to the bore of the firearm barrel and therefore does not adversely affect bullet accuracy. The weight 28 includes a threaded end 66 (FIG. 3) terminating at a beveled outer edge 68. An annular abutment shoulder 70 is formed on the weight 28 to engage the outlet end surface 26*c* of the main body portion 26. The outer end surface 72 constitutes the extreme muzzle end of the firearm.

A plurality of passageways 74 are formed in the weight 28 and extend radially perpendicularly outwardly from the longitudinal axis of the weight. The passageways 74 are oriented at 90° from one another. Opposed passageways are axially aligned with one another. The passageways enable a specially sized wrench (described in connection with FIG. 10) to be inserted through opposed passageways for installing and removing the weight 28 from the main body portion 26. The passageways 74 are located sufficiently close to the muzzle end surface 72 such that bullet accuracy is not appreciably affected from the exposed inner edges of passageways 74. It is to be understood that other structures and methods may be employed for securing and removing the weight 28 to the main body portion 26 without departing from the scope of the present invention.

Figure 4:
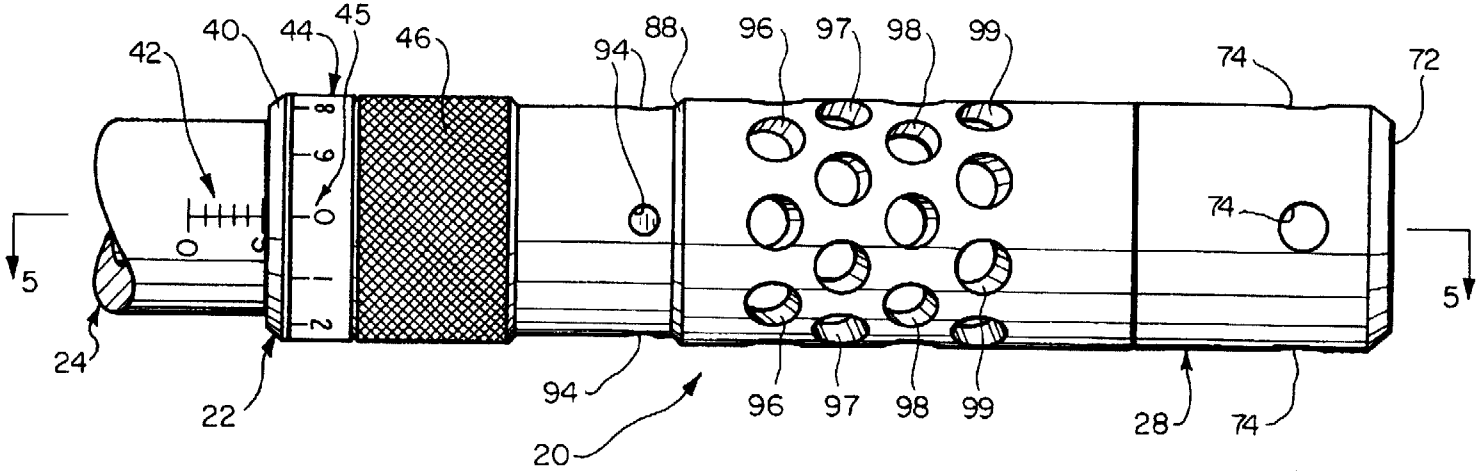
FIG. 4 is a top view of an alternative embodiment of the ballistic optimizing system including a main body portion having a two-tier outer surface and an alternative hole configuration formed in the main body portion.
Figure 5:
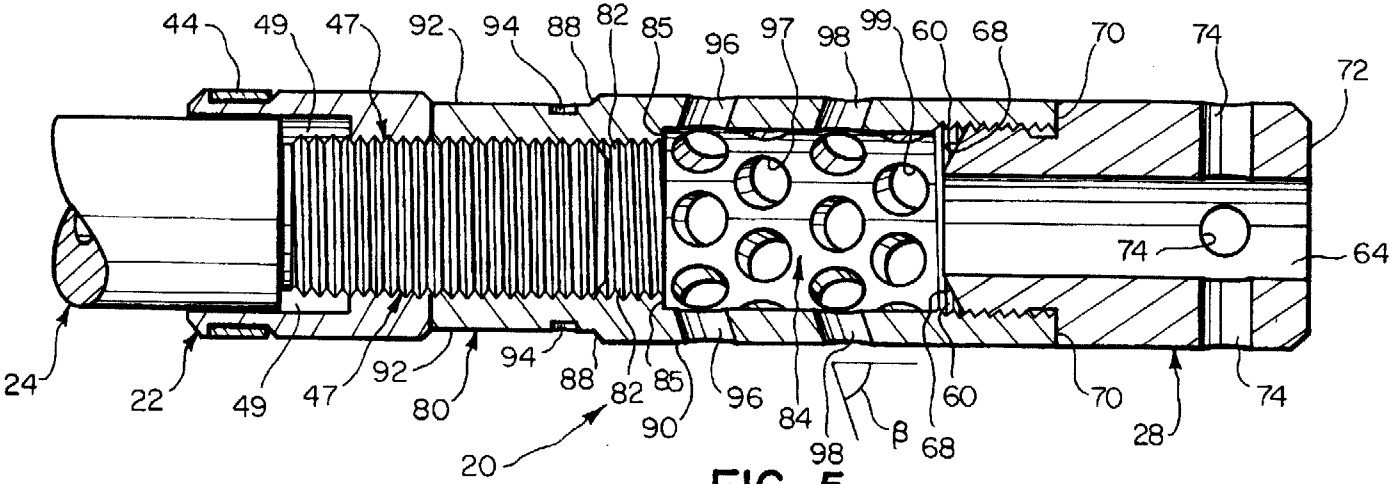
FIG. 5 is a partial sectional side elevation view, taken along the line 5—5 of FIG. 4, of an alternative embodiment of the invention.

FIGS. 4 and 5 show an alternative embodiment of the invention, including a main body portion 80 having a threaded section 82 formed at the inlet end, a venting chamber 84 formed within the middle section of the main body portion, and a threaded section 60 formed at the outlet end. Other than the alternative embodiment of the main body portion 80, the other components in FIGS. 4 and 5, namely the firearm barrel 24, the lock nut 22, and the weight element 28, are identical to those elements described above in connection with FIGS. 2 and 3.

The main body portion 80 includes a two-tiered surface: a large diameter, main outer surface 90 and a small diameter outer surface 92. A beveled edge surface 88 provides a transition from the large diameter outer surface 90 (FIG. 5) to the small diameter outer surface 92. A plurality of detents 94 are formed about the outer surface 92 at right angles relative to one another measured perpendicularly from the longitudinal axis of the ballistic optimizing system 20. The detents 94 are provided so that a specialized tool (described below) can be used to fasten the main body portion to and remove the main body portion from the firearm barrel 24.

A plurality of apertures 96, 97, 98, 99 are formed in the main body portion 80 to provide external vent ports communicating with the venting chamber 84. An annular shoulder 85 is formed in the main body portion 80 at one end of the venting chamber 84 adjacent the threaded section 82. The rows of radially extending apertures 96, 97, 98, 99 are formed in the outer wall, each aperture being oriented at an angle $\beta$ relative to the longitudinal axis of the main body portion 80. In the embodiments of FIGS. 4 and 5, angle $\beta$ is approximately 75°. Rows of apertures 96, 98 are aligned horizontally (as shown in FIGS. 4 and 5) with one another, and rows 97, 99 are likewise aligned horizontally with one another.

Figure 6:
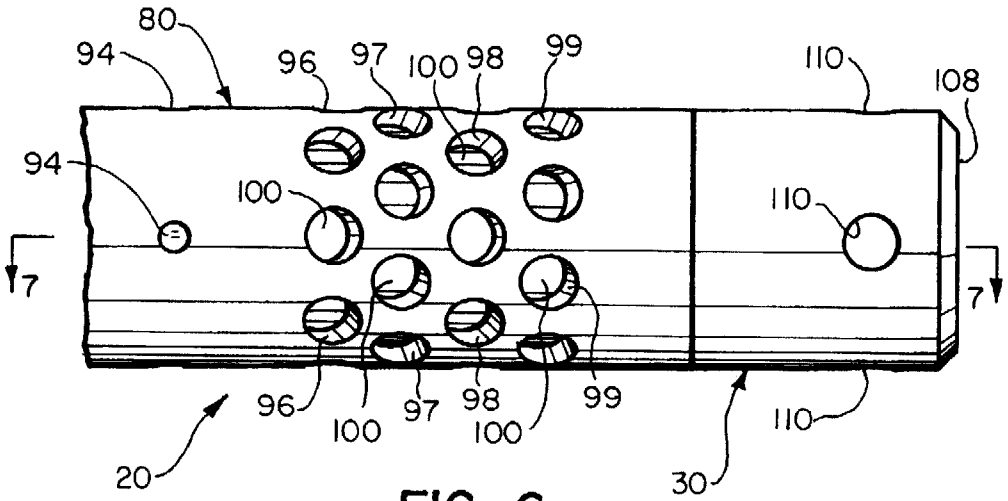
FIG. 6 is a partial top view of the ballistic optimizing system of FIG. 1 with a sleeved end piece secured to the outlet end of the main body portion to cover the vent apertures formed in the main body portion.
Figure 7:
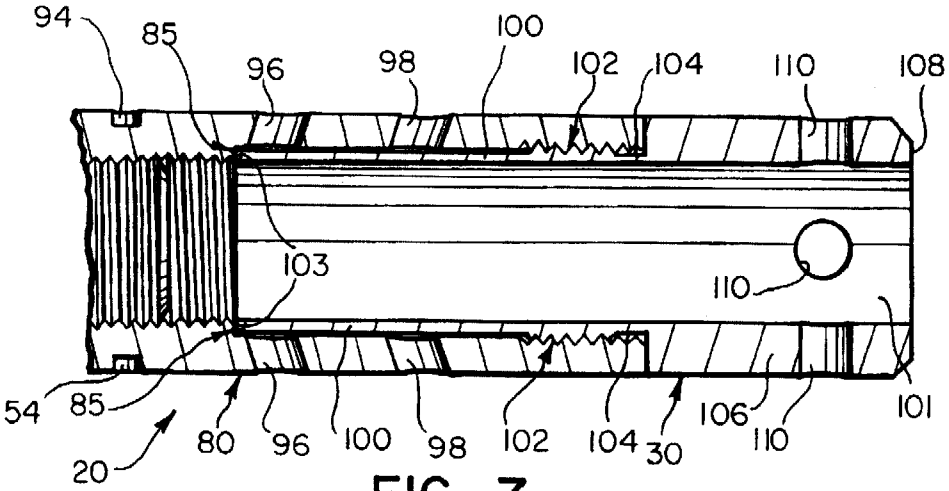
FIG. 7 is a partial sectional side elevation view, taken along the line 7—7 of FIG. 6, of the sleeved end piece threadedly secured within the main body portion.

FIGS. 6 and 7 show the details of the sleeved end piece 30 secured to the outlet end of the main body portion 80 (similar to what is shown in FIGS. 4 and 5). The sleeved end piece 30 comprises an elongated tubular sleeve section 100, a middle threaded portion 102, and an annular neck 104 formed between the threaded section 102 and an annular shoulder of the sleeved end piece. The sleeved end piece 30 includes a weighted end portion 106 which is outwardly configured similar to the interchangeable weight 28. The weighted end portion terminates at an outer edge 108, which becomes the muzzle end of the firearm. A plurality of passageways 110 extend perpendicularly outwardly from the longitudinal axis of the ballistic optimizing system 20. The passageways 110 are oriented at 90° relative to one another such that opposing passageways are aligned to allow for a tool 124 (described below in connection with FIG. 10) to be inserted into the sleeved end piece for tightening or loosening the end piece relative to the main body portion 80.

As an alternative to the weight 28, the sleeved end piece 30 can be secured to the outlet end of the main body portion 80. The sleeved end piece includes an annular distal end 103 (FIG. 7), which engages the annular shoulder 85 of the main body portion 80. The sleeved end piece covers the plurality of apertures 96, 97, 98, 99. To the extent that use of the apertures 96, 97, 98, 99 generates an increase in muzzle blast noise, the sleeved end piece 30 serves to prevent propulsion gases from passing through the apertures 96, 97, 98, 99 thereby disabling the muzzle brake and eliminating any increase in muzzle blast noise. The convertible ballistic optimizing system of the present invention provides the shooter with the option of changing in a matter of minutes to and from using a muzzle brake in connection with the adjustable weight feature.

Figure 8:
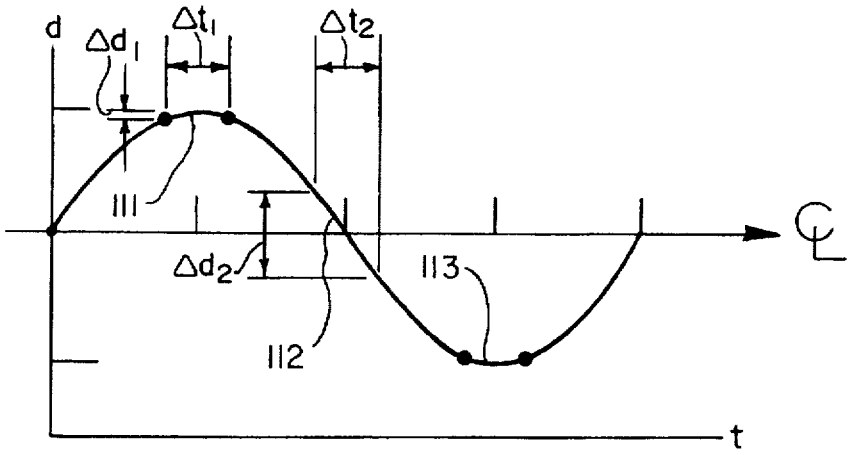
FIG. 8 is a graph showing representative transverse vibrational movement of a firearm barrel over time resulting from the discharge of a firearm.

FIG. 8 shows a graph representative of transverse barrel movement due to vibrations plotted against time t. The Y-axis indicates a representative amount of transverse barrel displacement d relative to the bore centerline (CL). The X-axis represents passage of a given amount of time. Barrel displacement is minimal at nodes 111, 113 located at extreme transverse positions of the firearm barrel. If the bullet exits the muzzle end when the firearm barrel is positioned at one of the nodes, the adverse effects of transverse barrel movement on bullet accuracy will be minimized. In contradistinction, if the bullet exits the muzzle end during the transition phase between nodes (such as location 112 in FIG. 8), where movement of the barrel is the greatest over a given period of time, the adverse effects of transverse barrel movement will substantially increase. Thus, utilizing the ballistic optimizing system of the present invention, the vibrational characteristics of the firearm barrel can be adjusted so that the bullet exits at one of the nodes, minimizing the adverse effects of transverse barrel movement.

More specifically, as shown in FIG. 8, a node is shown at the top of the vibration curve which corresponds to a given time period $\Delta t_1$. The amount of barrel movement $\Delta d_1$ is minimal over time period $\Delta t_1$ at node 111. For the same time differential $\Delta t_2$, it can be observed that a dramatic increase in barrel movement $\Delta d_2$ takes place during transition between nodes. It stands to reason, therefore, that a bullet exiting the firearm barrel at one of the nodes 111 or 113 will experience fewer adverse effects from transverse barrel movement than a bullet that exits during the period of maximum barrel movement, such as at location 112. The nodes 111, 113 correspond to so-called "sweetspots" when tuning a firearm barrel to match a particular bullet. When the barrel is tuned so that the bullet exit corresponds with a node, an extremely high degree of shooting accuracy results. Representative accuracy results from use of a ballistic optimizing system are set forth in U.S. Pat. No. 5,279,200.

Adjustments to the ballistic optimizing system are made with reference to the indicia 45 on the lock nut 22 and the indicia 42 on the firearm barrel 24 (FIGS. 2 and 4). Adjustments are made by moving the lock nut axially toward or away from the muzzle end of the firearm. When the lock nut is positioned at a desired axial position on the firearm barrel, the main body portion 26 is rotated into engagement with the lock nut 22 to secure the main body portion in position against abutment surface 48 (FIG. 3) of the lock nut. The end weight 28 can be threaded into the outlet end of the main body portion 26 if the muzzle brake aspect of the present invention is desired. Alternatively, the sleeved end piece 30 can be threaded into the outlet end of the main body portion 26 so that the sleeved segment 100 covers the apertures and disables the muzzle brake. The sleeved end piece includes a continuous, uniform, cylindrical inner surface through which the bullet passes. The cylindrical surface minimizes turbulence. The smooth cylindrical inner surface provides substantially superior bullet accuracy as compared to a situation where apertures might be covered externally, since the edges of the apertures would remain exposed to the inside of the venting chamber and increased turbulence would result.

The lock nut 22, the main body portion 26, and either the weight 28 or the sleeved end piece 30 contribute to the total adjustable weight of the ballistic optimizing system. Adjustment of the total weight of the system axially along the firearm barrel will affect bullet accuracy. When the weight 28 is removed from the main body portion, and a sleeved end piece 30 (similar to what is shown in FIGS. 6 and 7) is attached to the end of the main body portion, preferably the characteristics of the ballistic optimizing system do not appreciably change so as to affect bullet accuracy to any significant degree. To achieve the appropriate weight characteristics and balance, the sleeved end piece 30 is constructed so that these characteristics do not change. One method of matching a particular sleeved end piece with a particular weight is to equate (1) the moment arm times the mass of the combined main body portion and the weight, and (2) the moment arm and mass of the combined main body portion and the sleeved end piece. The moment arm of each system is the distance between the center of gravity of the particular system and the end of the main body portion that abuts the lock nut. That is, the moment arm distance of each of these respective combinations would be measured from the center of gravity to the rear edge of the main body portion that engages the lock nut. By equating these two variables, interchangeable combinations of weights and sleeved end pieces can be provided so that bullet accuracy is not significantly affected by the change.

Figure 9:
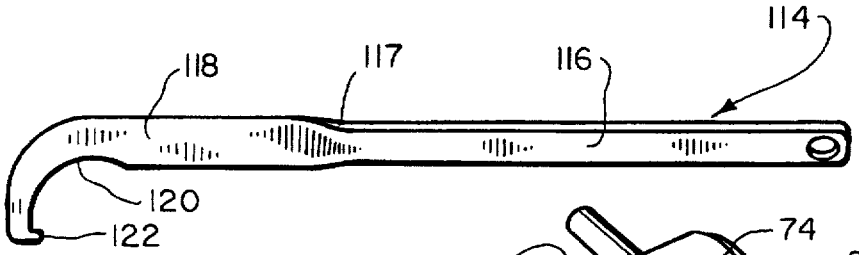
FIG. 9 is a side elevation view of a specialized tool for tightening and loosening the main body portion to the muzzle end of a firearm barrel to engage the lock nut.
Figure 10:
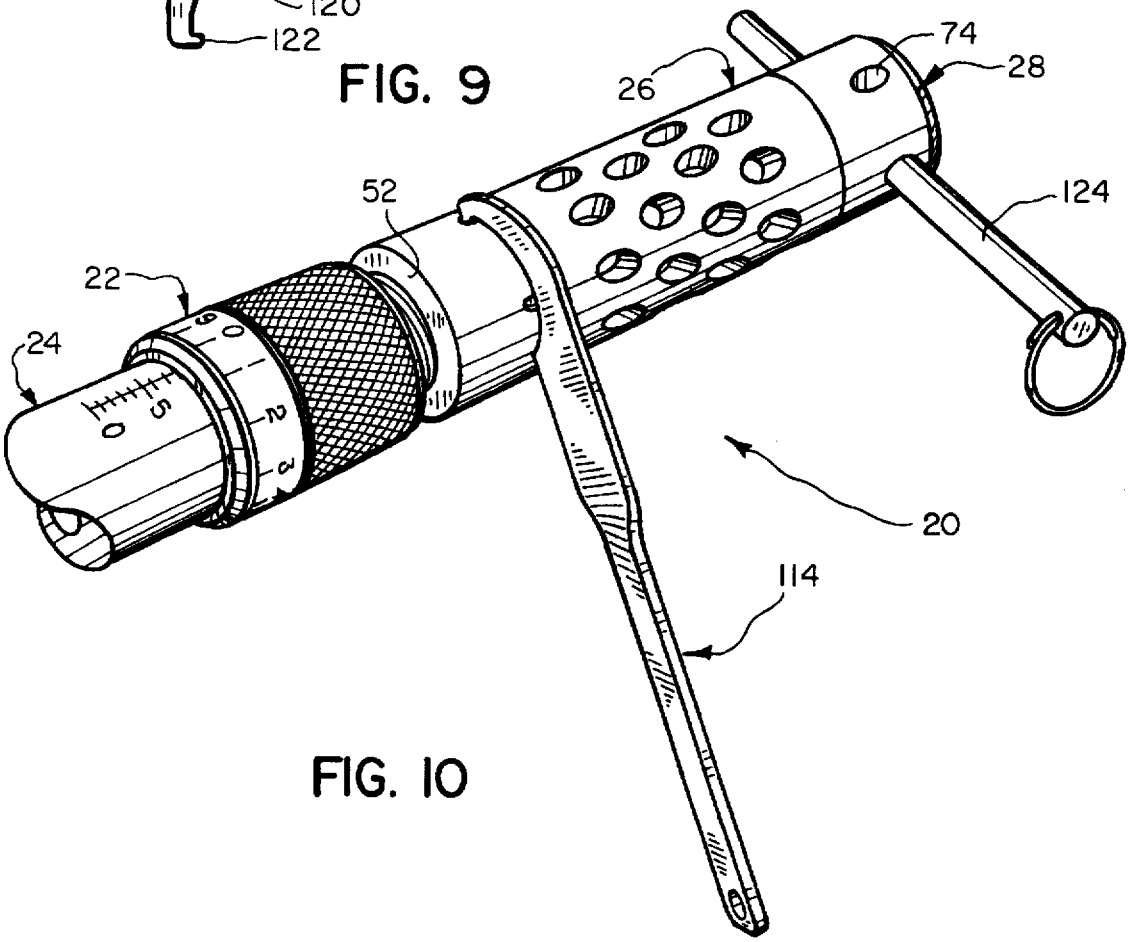
FIG. 10 is a perspective view showing the tool of FIG. 9 and a specialized wrench being used to remove the main body portion from the distal end of the firearm barrel and the weight from the main body portion.

FIG. 9 shows a tool 114 having a handle segment 116 and a distal working end segment 118. The working segment defines a radius of curvature 120 which corresponds substantially to the outer diameter of the main body portion 26. A protuberance or hook portion 122 is formed at the extreme distal end of the tool 114 and is sized to fit inside detents 54 (FIG. 1). Utilization of the tool (as shown in FIG. 10) will allow the user to tighten the main body portion 26 so that it firmly engages lock nut 22; alternatively, the tool 114 can be used to loosen the main body portion from firm engagement with lock nut 22 as shown in FIG. 10. The tool includes a twist at location 117 to facilitate use of the tool for tightening or loosening of the main body portion against lock nut 22. It should be noted that other alternative methods of securing or removing the various components of the convertible optimizing shooting system may be used without departing from the scope of the invention. For example, conventional flat surfaces with wrench may be formed on one or more of the components and a conventional wrench used to tighten or loosen the components.

FIG. 10 also shows a wrench 124 which consists of a solid cylindrical body sized for insertion through opposed apertures 110 in the sleeved end piece (or alternatively apertures 74 in the end weight 28). The wrench 124 facilitates securing the end weight 28 (or the sleeved end piece 30) to the outlet end of the main body portion 26 and allows the weight 28 to be removed from the main body portion.

Figure 11:
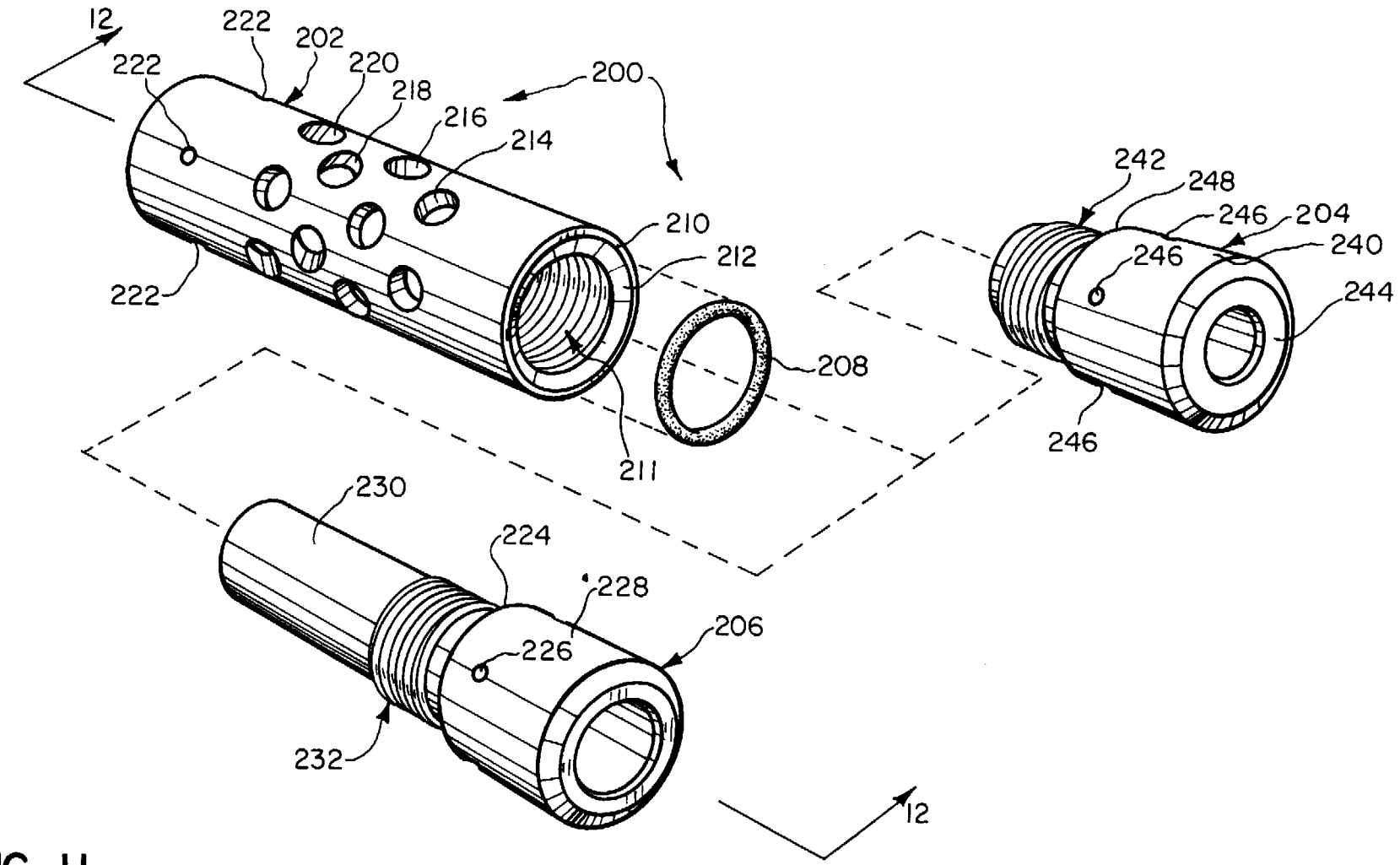
FIG. 11 is an exploded perspective view of an alternative embodiment of the convertible ballistic optimizing system of the present invention.

FIG. 11 shows an exploded perspective view of an alternative embodiment of a convertible ballistic optimizing system 200 according to the present invention. The system comprises a main body portion 202 and interchangeable components comprising a weight 204 and a sleeved end piece 206. The main body portion 202 includes aspects similar to previous embodiments, including a plurality of apertures 214, 216, 218, 220, and a plurality of detents 222 such that a tool (similar to that shown in FIGS. 8 and 9) can be used to secure the main body portion to a firearm barrel. The weight 204 includes a threaded section 242 which is to be threadedly inserted into opening 211 of the main body portion, a perpendicularly extending shoulder 248 for engaging surface 210 of the main body portion, detents 246 into which a tool (similar to that shown in FIGS. 8 and 9) can be inserted for removing the weight from or installing the weight on the main body portion. Also, the weight includes an outer cylindrical surface 240 which corresponds to the outer surface of the main body portion. The weight terminates at an extreme distal end surface 244.

The sleeved end piece 206 can alternatively be used in connection with the embodiment shown in FIG. 11. The sleeved end piece 206 includes elements similar to the sleeved end piece that has been shown and described previously. For example, the sleeved end piece 206 includes a tubular sleeve section 230, a distal end portion 228, a threaded portion 232 which is threadedly received into opening 211 of the main body portion, a radially perpendicularly extending shoulder 224 for abutment with outer edge 210 of the main body portion, and a plurality of detents 226 for receiving a tool (similar to that shown in FIGS. 8 and 9) for installing and removing the sleeved end piece from the main body portion.

A resilient, compressible structure 208, such as a synthetic O-ring, is preferably disposed between the weight 204 or the sleeved end piece 206 and the main body portion 202. After repeatedly discharging the firearm, there is a tendency for relative movement to occur between the main body portion and either the weight or the sleeved end piece. The O-ring serves as a lock washer to prevent relative rotation or movement between the components.

Figure 12:
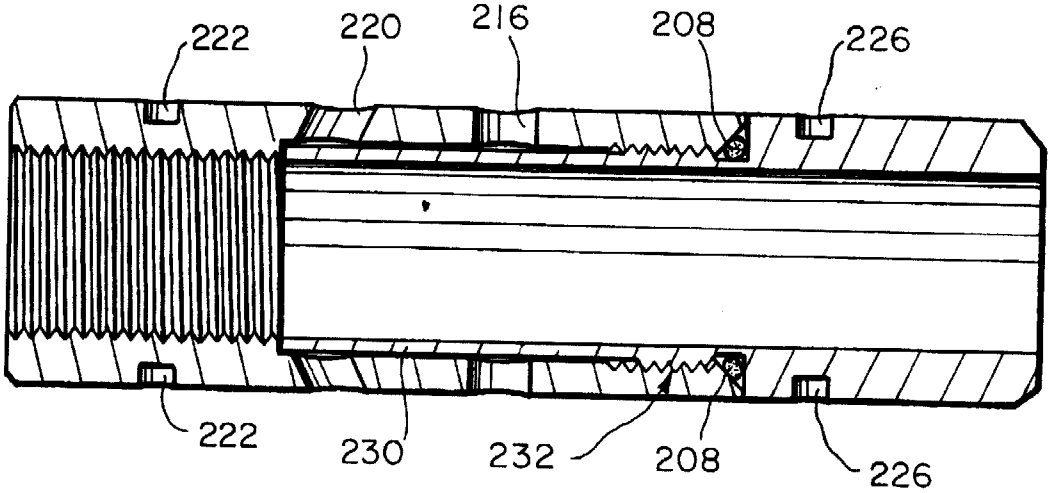
FIG. 12 is a sectional side elevation view of the main body portion and the sleeved end piece, taken along the line 12—12 of FIG. 11, of the alternative embodiment of the present invention.
Figure 13:
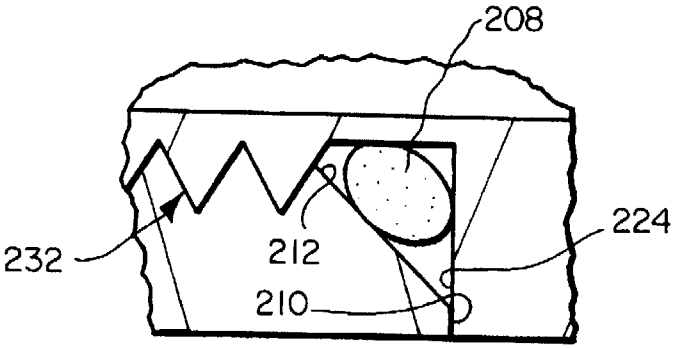
FIG. 13 is an enlarged partial sectional side elevation view of the O-ring seal shown in FIG. 12.

The main body portion includes a flat end surface 210 and a sloped surface 212 that tapers angularly inwardly from surface 210 toward the longitudinal axis of the main body portion. The sloped surface 212 is sized to receive the resilient O-ring 208 such that when either the weight 204 is threadedly inserted into opening 211 or the threaded end piece 206 is threaded into opening 211, the resilient O-ring 208 is resiliently compressed between the components restricting relative movement therebetween. A representative diagram of one such embodiment is shown in FIGS. 12 and 13. It can be seen that the resilient O-ring 208 bears against the sloped surface 212 and a flat surface of shoulder 224. The size or thickness of the O-ring 208 shown in FIG. 13 allows the shoulder 224 of the sleeved end piece to bear against the flat end surface 210 of the main body portion. Accordingly, precise relative positions can be maintained between the main body portion and either the weight or the sleeved end piece, yet the resilient O-ring 208 will be compressed between the two components preventing relative movement resulting from repeated discharging from the firearm.

The present invention has been described and shown according to preferred embodiments and the best mode contemplated by the inventor, in terms of structural and methodical features. It is to be understood, however, that the invention is not limited to the specific features shown and described, since the various embodiments shown and described comprise preferred forms of carrying out the invention. The invention is, therefore, claimed in any of its forms or modifications with the proper scope of the appended claims appropriately interpreted in accordance with the doctrine of equivalents.

What is claimed is:

1. A convertible ballistic optimizing system for a firearm, comprising:

a main body portion adjustably securable to a firearm barrel having a muzzle end, the main body portion having a middle section, the main body portion being axially adjustable to optimize bullet accuracy;

a retaining number cooperating with the main body portion to lock the main body portion at a particular axial position on the firearm barrel;

a plurality of apertures formed in the middle section of the main body, the apertures forming a muzzle brake to vent bullet propulsion gases from the firearm barrel upstream of the muzzle;

a weight securable to the main body portion, the weight remaining clear of the apertures to leave the apertures completely unobstructed when the weight is secured to the main body portion;

a sleeved end piece securable to the main body portion, the sleeved end piece being interchangeable with the weight, the sleeved end piece covering the apertures when secured to the main body portion to disable the muzzle brake and direct bullet propulsion gases out of the muzzle end of the system while maintaining optimal bullet accuracy.

2. A convertible ballistic optimizing system according to claim 1 wherein the sleeved end piece includes a cylindrical inner surface.

3. A convertible ballistic optimizing system according to claim 1 wherein the sleeved end piece includes a continuous, uniform, cylindrical inner surface.

4. A convertible ballistic optimizing system for a firearm, comprising:

a main body portion adjustably securable to a firearm barrel having a muzzle end, the main body portion having a middle section, the main body portion being axially adjustable to optimize bullet accuracy;

a retaining member cooperating with the main body portion to lock the main body portion at a particular axial position on the firearm barrel;

a plurality of apertures formed in the middle section of the main body, the apertures forming a muzzle brake to vent bullet propulsion gases from the firearm barrel upstream of the muzzle;

a weight securable to the main body portion, the weight leaving the apertures unobstructed when secured to the main body portion;

a sleeved end piece securable to the main body portion, the sleeved end piece being interchangeable with the weight, the sleeved end piece covering the apertures when secured to the main body portion to disable the muzzle brake and direct bullet propulsion gases out of the muzzle end of the system while maintaining optimal bullet accuracy;

wherein the weight and the sleeved end piece are matched with respect to total weight multiplied by distance from an end to a center of gravity such that interchanging the weight and the sleeved end piece does not appreciably affect accuracy of the firearm.

5. A convertible ballistic optimizing system according to claim 1 wherein the weight and the sleeved end piece are matched with respect to their respective weight and length characteristics such that interchanging the weight with the sleeved end piece does not appreciably affect accuracy of the firearm.

6. A convertible ballistic optimizing system according to claim 1 wherein the main body portion defines an inner venting chamber communicating with the apertures, the sleeved end piece being insertable into the main body portion to cover the apertures.

7. A convertible ballistic optimizing system according to claim 1, further comprising a resilient O-ring disposed between either the weight or the sleeved end piece and the main body portion to prevent relative movement therebetween.

8. A convertible ballistic optimizing system for a firearm, comprising:

a main body portion adjustably securable to a firearm barrel having a muzzle end, the main body portion having a middle section, the main body portion being axially adjustable to optimize bullet accuracy;

a retaining member cooperating with the main body portion to lock the main body portion at a particular axial position on the firearm barrel;

a plurality of apertures formed in the middle section of the main body, the apertures forming a muzzle brake to vent bullet propulsion gases from the firearm barrel upstream of the muzzle;

a weight securable to the main body portion, the weight leaving the apertures unobstructed when secured to the main body portion;

a sleeved end piece securable to the main body portion, the sleeved end piece being interchangeable with the weight, the sleeved end piece covering the apertures when secured to the main body portion to disable the muzzle brake and direct bullet propulsion gases out of the muzzle end of the system while maintaining optimal bullet accuracy;

wherein the main body portion defines an inner venting chamber and an annular shoulder at one end of the inner venting chamber, the inner venting chamber communicating with the apertures, the sleeved end piece having an annular distal end, the sleeved end piece being insertable into the main body portion such that the annular distal end of the sleeved end piece engages the annular shoulder to cover the apertures and direct propulsion gases out of the muzzle end of the system.

9. A convertible ballistic optimizing shooting system for a firearm, comprising:

a muzzle brake adjustably secured to a firearm barrel, the muzzle brake including a plurality of apertures to vent propulsion gases generated when a bullet is discharged from the firearm barrel, a weight securable to the muzzle brake with the weight remaining clear of the apertures;

the combined muzzle brake and weight being axially adjustable along the firearm barrel to adjust firearm barrel vibrations and obtain optimized bullet accuracy;

a sleeved end piece securable to the muzzle brake when the weight is removed to cover the apertures to disable the muzzle brake, yet maintain optimized bullet accuracy due to proper adjustment of barrel vibrations.

10. A convertible ballistic optimizing system according to claim 9 wherein the sleeved end piece includes a cylindrical inner surface.

11. A convertible ballistic optimizing system according to claim 9 wherein the sleeved end piece includes a continuous, uniform, cylindrical inner surface.

12. A convertible ballistic optimizing shooting system for a firearm, comprising:

a lock nut adjustably securable to a firearm barrel;

a main body portion having an inlet end, an outlet end, and a middle section, the inlet end of the main body portion being adjustably securable to the firearm barrel, the main body portion and the lock nut cooperating to lock one another at a particular axial position on the firearm barrel corresponding to optimal bullet accuracy;

a plurality of apertures formed in the middle section of the main body, the apertures forming passageways to vent propulsion gases generated when discharging a bullet from the firearm barrel;

a weight securable to the outlet end of the main body portion, the weight remaining clear of the apertures to leave the apertures completely unobstructed when the weight is secured to the main body portion;

a sleeved end piece having a sleeve portion, the sleeved end piece being securable to the main body portion such that the sleeve portion completely covers the apertures and directs propulsion gases out of the muzzle end of the system;

the weight and the sleeved end piece being interchangeably and alternatively securable to the outlet end of the main body portion such that optimal bullet accuracy is maintained whether the weight or the sleeved end piece is secured to the outlet end.

13. A convertible ballistic optimizing system according to claim 12 wherein the sleeved end piece includes a cylindrical inner surface.

14. A convertible ballistic optimizing system according to claim 12 wherein the sleeved end piece includes a continuous, uniform, cylindrical inner surface.

15. A convertible ballistic optimizing shooting system for a firearm, comprising:

a lock nut adjustably securable to a firearm barrel;

a main body portion having an inlet end, an outlet end, and a middle section, the inlet end of the main body portion being adjustably securable to the firearm barrel, the main body portion and the lock nut cooperating to lock one another at a particular axial position on the firearm barrel;

a plurality of apertures formed in the middle section of the main body, the apertures forming passageways to vent propulsion gases generated when discharging a bullet from the firearm barrel;

a weight securable to the outlet end of the main body portion;

a sleeved end piece having a sleeve portion securable to the main body portion to cover the apertures and direct propulsion gases out of the muzzle end of the system;

the weight and the sleeved end piece being interchangeably securable to the outlet end of the main body portion;

wherein the weight and the sleeved end piece are matched with respect to total weight multiplied by distance from an end to a center of gravity such that interchanging the weight and the sleeved end piece does not appreciably affect accuracy of the firearm.

16. A convertible ballistic optimizing system according to claim 12 wherein the weight and the sleeved end piece are matched with respect to their respective weight and length characteristics such that interchanging the weight with the sleeved end piece does not appreciably affect accuracy of the firearm.

17. A convertible ballistic optimizing system according to claim 12 wherein the main body portion defines an inner venting chamber communicating with the apertures, the sleeved end piece being insertable into the main body portion to cover the apertures.

18. A convertible ballistic optimizing system according to claim 12, further comprising a resilient O-ring disposed between either the weight or the sleeved end piece and the main body portion to prevent relative movement therebetween.

19. A convertible ballistic optimizing shooting system for a firearm, comprising:

a lock nut adjustably securable to a firearm barrel;

a main body portion having an inlet end, an outlet end, and a middle section, the inlet end of the main body portion being adjustably securable to the firearm barrel, the main body portion and the lock nut cooperating to lock one another at a particular axial position on the firearm barrel;

a plurality of apertures formed in the middle section of the main body, the apertures forming passageways to vent propulsion gases generated when discharging a bullet from the firearm barrel;

a weight securable to the outlet end of the main body portion;

a sleeved end piece having a sleeve portion securable to the main body portion to cover the apertures and direct propulsion gases out of the muzzle end of the system;

the weight and the sleeved end piece being interchangeably securable to the outlet end of the main body portion;

wherein the main body portion defines an inner venting chamber and an annular shoulder at one end of the inner venting chamber, the inner venting chamber communicating with the apertures, the sleeved end piece having an annular distal end, the sleeved end piece being insertable into the main body portion such that the annular distal end of the sleeved end piece engages the annular shoulder to cover the apertures and direct propulsion gases out of the muzzle end of the system.

20. A method of optimizing the accuracy of a bullet discharged from a firearm barrel, comprising the steps of:

attaching a main body portion to a muzzle end of a firearm barrel, the main body portion including a plurality of apertures for venting propulsion gases generated from discharging a bullet from the firearm barrel;

retaining the main body portion at a particular axial position on the firearm barrel to dampen barrel vibrations and optimize bullet accuracy;

affixing alternatively a weight and a sleeved end piece to the main body portion, the sleeved end piece covering the apertures of the main body portion when secured to the main body portion to direct propulsion gases, generated when firing a bullet, out of the muzzle end of the firearm, the weight remaining clear of the apertures to leave the apertures completely unobstructed when the weight is secured to the main body portion to vent propulsion gases from the firearm barrel upstream of the muzzle end wherein the alternate affixing does not appreciably change the barrel vibrations which correspond to optimized bullet accuracy.

21. The method of claim 20, further comprising the steps of:

removing one of the sleeved end piece or the weight from the main body portion;

securing the other of the sleeved end piece or the weight to the outlet end of the main body portion.

22. The method of claim 20 wherein the step of securing the sleeved end piece to the main body portion comprises securing the sleeved end piece to an outlet end of the main body portion.

23. The method of claim 20 wherein the step of retaining the main body portion at a particular axial position comprises attaching a lock nut to the firearm barrel such that the lock nut engages the main body portion and prevents the main body portion from moving axially along the firearm barrel.

24. A method of optimizing the accuracy of a bullet discharged from a firearm barrel, comprising the steps of:

attaching an adjustable retaining member to a firearm barrel;

attaching a main body portion to the firearm barrel adjacent the retaining member, the main body portion including an inlet end, an outlet end, and a middle portion, the main body portion including a plurality of apertures for venting propulsion gases generated from propelling a bullet through the firearm barrel, wherein engagement of the main body portion with the retaining member prevents movement of the main body portion and the retaining member relative to the firearm barrel, the main body portion and the lock nut being positioned at a location on the firearm barrel to dampen barrel vibrations and optimize bullet accuracy;

matching a weight and a sleeved end piece with each other so that one may be interchanged with the other on the outlet end of the main body portion without changing appreciably the barrel vibrations which correspond to optimized bullet accuracy;

affixing one of either the weight or the sleeved end piece to the outlet end of the main body portion, the sleeved end piece covering the apertures of the main body portion when affixed to the end of the main body portion, the weight remaining clear of the apertures when affixed to the end of the main body portion.

25. A method for interchanging parts of a ballistic optimizing system without adversely affecting optimal bullet accuracy, comprising the steps of:

providing a firearm barrel;

providing a main body portion securable at various axial locations on the firearm barrel, the main body portion having an outlet end;

providing a lock to secure the main body portion on the firearm barrel at a particular location;

securing one of a weight or a sleeved end piece on the outlet end of the main body portion;

moving the combined main body portion, the lock, and one of the weight or the sleeved end piece axially along the firearm barrel to a location for damping barrel vibrations which corresponds to optimal bullet accuracy;

removing the one of the weight or the sleeved end piece from the main body portion;

securing the other of the weight or the sleeved end piece to the main body portion without appreciably altering barrel vibrations corresponding to optimal bullet accuracy.

* * * * *